US010127882B2

(12) United States Patent
Kim et al.

(10) Patent No.: US 10,127,882 B2
(45) Date of Patent: Nov. 13, 2018

(54) METHOD OF DRIVING A DISPLAY APPARATUS, A DISPLAY APPARATUS PERFORMING THE SAME AND A TIMING CONTROLLER INCLUDED IN THE DISPLAY APPARATUS

(71) Applicant: SAMSUNG DISPLAY CO., LTD., Yongin-si, Gyeonggi-Do (KR)

(72) Inventors: Ga-Na Kim, Icheon-si (KR); Dong-Won Park, Hwaseong-si (KR); Po-Yun Park, Seoul (KR); Jimyoung Seo, Hwaseong-si (KR); Whee-Won Lee, Busan (KR); Bonghyun You, Seongnam-si (KR); Jung Hwan Cho, Asan-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 33 days.

(21) Appl. No.: 15/214,966

(22) Filed: Jul. 20, 2016

(65) Prior Publication Data

US 2017/0206850 A1 Jul. 20, 2017

(30) Foreign Application Priority Data

Jan. 14, 2016 (KR) ..... 10-2016-0004962

(51) Int. Cl.
*G09G 5/00* (2006.01)
*G09G 3/36* (2006.01)

(52) U.S. Cl.
CPC ..... *G09G 3/3696* (2013.01); *G09G 3/3655* (2013.01); *G09G 2310/061* (2013.01); *G09G 2310/08* (2013.01); *G09G 2320/0247* (2013.01); *G09G 2320/0257* (2013.01); *G09G 2330/021* (2013.01); *G09G 2340/0435* (2013.01)

(58) Field of Classification Search
None
See application file for complete search history.

(56) References Cited

U.S. PATENT DOCUMENTS

2005/0140632 A1* 6/2005 Tsuda ..... G02F 1/136213 345/92
2013/0113811 A1 5/2013 Choi et al.
2014/0139504 A1 5/2014 Zhang et al.

OTHER PUBLICATIONS

Search Report dated Mar. 29, 2017 from the European Patent Office in the corresponding European Patent Application No. 16189227.8.
European Office Action dated Jul. 10, 2018 issued in corresponding European Patent Application No. 16189227.8.

* cited by examiner

*Primary Examiner* — Ifedayo Iluyomade
(74) *Attorney, Agent, or Firm* — F. Chau & Associates, LLC

(57) ABSTRACT

A method of driving a display apparatus includes determining a duration of a blank interval between a first frame and a second frame, wherein the second frame is subsequent to the first frame, and modulating a common voltage during the blank interval when the duration is longer than a first reference time, wherein an average of the common voltage is fixed during the blank interval.

29 Claims, 13 Drawing Sheets

| LUT1 | | LUT2 | | LUT3 | |
|---|---|---|---|---|---|
| FREQ:60Hz | | FREQ:48Hz | | FREQ:40Hz | |
| ARP | DVR | ARP | DVR | ARP | DVR |
| 60Hz | 66 | 48Hz | 60 | 40Hz | 55 |
| 30Hz | 66 | 24Hz | 61 | 20Hz | 55 |
| 12Hz | 67 | 9.6Hz | 62 | 8Hz | 56 |
| ⋮ | ⋮ | ⋮ | ⋮ | ⋮ | ⋮ |

METHOD OF DRIVING A DISPLAY APPARATUS, A DISPLAY APPARATUS PERFORMING THE SAME AND A TIMING CONTROLLER INCLUDED IN THE DISPLAY APPARATUS

CROSS-REFERENCE TO RELATED APPLICATION

This application claims priority under 35 U.S.C. § 119 to Korean Patent Application No. 10-2016-0004962, filed on Jan. 14, 2016 in the Korean Intellectual Property Office (KIPO), the disclosure of which is incorporated by reference herein in its entirety.

TECHNICAL FIELD

Exemplary embodiments of the present inventive concept relate generally to display devices, and more particularly to methods of driving display apparatuses, display apparatuses performing the methods and timing controllers included in the display apparatuses.

DESCRIPTION OF THE RELATED ART

Generally, a liquid crystal display ("LCD") apparatus includes a first substrate including a pixel electrode, a second substrate including a common electrode and a liquid crystal layer disposed between the first substrate and the second substrate. An electric field is generated by voltages applied to the pixel electrode and the common electrode. By adjusting an intensity of the electric field, a transmittance of light passing through the liquid crystal layer may be adjusted so that an image may be displayed.

A driving frequency may vary according to driving options. For example, since a common voltage may be controlled according to the driving frequency, the driving frequency may be varied to generate an optimum common voltage for reducing flickers and afterimages.

A Frame Masking Driving ("FMD") method may be used to change the driving frequency. In this method, by masking some frames, blank intervals between frames are extended.

SUMMARY

A method of driving a display apparatus according to an exemplary embodiment of the present inventive concept includes determining a duration of a blank interval between a first frame and a second frame, wherein the second frame is subsequent to the first frame, and modulating a common voltage during the blank interval when the duration is longer than a first reference time, wherein an average of the common voltage is fixed during the blank interval.

In an exemplary embodiment of the present inventive concept, modulating the common voltage may include swinging the common voltage between a first voltage level and a second voltage level.

In an exemplary embodiment of the present inventive concept, the duration may be a multiple of a swinging period of the modulated common voltage.

In an exemplary embodiment of the present inventive concept, a swinging period of the modulated common voltage may be substantially the same as the duration when the duration is longer than the first reference time and equal to or shorter than a second reference time, and the swinging period may be substantially the same as the second reference time when the duration is longer than the second reference time.

In an exemplary embodiment of the present inventive concept, the duration may be a multiple of the second reference time.

In an exemplary embodiment of the present inventive concept, the method may further include detecting a driving frequency of a display panel, and determining the first and second voltage levels in response to the driving frequency.

In an exemplary embodiment of the present inventive concept, a swinging amplitude of the modulated common voltage may be substantially the same as a difference of the average of the common voltage and the first voltage level.

In an exemplary embodiment of the present inventive concept, detecting the driving frequency may include comparing an input signal count value with a plurality of reference count values, the input signal count value being generated by counting an oscillation clock in response to an input signal.

In an exemplary embodiment of the present inventive concept, determining the first and second voltage levels may include referring to a look-up table where a plurality of first values respectively corresponding to a plurality of driving frequencies is stored.

In an exemplary embodiment of the present inventive concept, modulating the common voltage may include modulating the common voltage to have a sine wave during the blank interval.

In an exemplary embodiment of the present inventive concept, modulating the common voltage may include modulating the common voltage to have a triangle wave during the blank interval.

In an exemplary embodiment of the present inventive concept, determining the duration may include counting oscillation clocks during the blank interval.

In an exemplary embodiment of the present inventive concept, the method may further include masking at least one frame between the first and second frames in response to an input signal to extend the blank interval.

In an exemplary embodiment of the present inventive concept, determining the duration may include determining a duration of the extended blank interval.

In an exemplary embodiment of the present inventive concept, the method may further include holding the common voltage at a fixed level during the blank interval when the duration is equal to or shorter than the first reference time.

A display apparatus according to an exemplary embodiment of the present inventive concept includes a timing controller including a blank interval determining part configured to determine a duration of a blank interval between a first frame and a second frame, wherein the second frame is subsequent to the first frame, a comparing part configured to compare the duration with a first reference time, and a common voltage controller configured to generate a first common voltage control signal when the duration is longer than the first reference time, a common voltage generator configured to generate a first common voltage in response to the first common voltage control signal, the first common voltage being modulated during the blank interval, an average of the common voltage being fixed during the blank interval, and a display panel configured to be driven in response to the first common voltage.

In an exemplary embodiment of the present inventive concept, the first common voltage may be swung between a first voltage level and a second voltage level.

In an exemplary embodiment of the present inventive concept, the duration may be a multiple of a swinging period of the first common voltage.

In an exemplary embodiment of the present inventive concept, the comparing part may be configured to compare the duration with a second reference time, and a swinging period of the first common voltage may be substantially the same as the duration when the duration is longer than the first reference time and equal to or shorter than the second reference time, and the swinging period may be substantially the same as the second reference time when the duration is longer than the second reference time.

In an exemplary embodiment of the present inventive concept, the timing controller may further include a frequency detecting part configured to detect a driving frequency of the display panel and a first generator configured to generate a first value determining the first and second voltage levels in response to the driving frequency.

In an exemplary embodiment of the present inventive concept, the frequency detecting part may include an oscillation clock counter configured to count an oscillation clock in response to an input signal to generate an input signal count value, a reference value storing part configured to store a plurality of reference count values respectively corresponding to a plurality of driving frequencies, and a frequency determining part configured to compare the input signal count value with each of the reference count values to determine the driving frequency of the display panel.

In an exemplary embodiment of the present inventive concept, the first generator may include a look-up table storing a plurality of first values respectively corresponding to a plurality of driving frequencies.

In an exemplary embodiment of the present inventive concept, the first common voltage may be a sine wave modulated during the blank interval.

In an exemplary embodiment of the present inventive concept, the first common voltage may be a triangle wave modulated during the blank interval.

In an exemplary embodiment of the present inventive concept, the blank interval determining part may include an oscillation clock counter configured to count oscillation clocks during the blank interval.

In an exemplary embodiment of the present inventive concept, the display apparatus may further include a frame masking part configured to mask at least one frame between the first and second frames in response to an input signal to extend the blank interval.

In an exemplary embodiment of the present inventive concept, the blank interval determining part may be further configured to determine a duration of the extended blank interval.

In an exemplary embodiment of the present inventive concept, the common voltage controller may be further configured to generate a second common voltage control signal when the duration is equal to or shorter than the first reference time, and the common voltage generator may be further configured to generate a second common voltage in response to the second common voltage control signal, the second common voltage being fixed during the blank interval.

A timing controller according to an exemplary embodiment of the present inventive concept includes a blank interval determining part configured to determine a duration of a blank interval between a first frame and a second frame, wherein the second frame is subsequent to the first frame, a comparing part configured to compare the duration with a first reference time, and a common voltage controller configured to generate a common voltage control signal when the duration is longer than the first reference time, wherein the common voltage control signal controls a common voltage to be modulated and an average of the common voltage to be fixed during the blank interval.

In an exemplary embodiment of the present inventive concept, the common voltage control signal may control the common voltage to be swung between a first voltage level and a second voltage level.

In an exemplary embodiment of the present inventive concept, the blank interval determining part may include an oscillation clock counter configured to count oscillation clocks during the blank interval.

In an exemplary embodiment of the present inventive concept, the timing controller may further include a frame masking part configured to mask at least one frame between the first and second frames in response to an input signal to extend the blank interval.

BRIEF DESCRIPTION OF THE DRAWINGS

The above and other features of the present inventive concept will become more apparent by describing in detail exemplary embodiments thereof with reference to the accompanying drawings, in which.

DETAILED DESCRIPTION OF THE EMBODIMENTS

Hereinafter, exemplary embodiments of the present inventive concept will be explained in detail with reference to the accompanying drawings.

Figure 1:
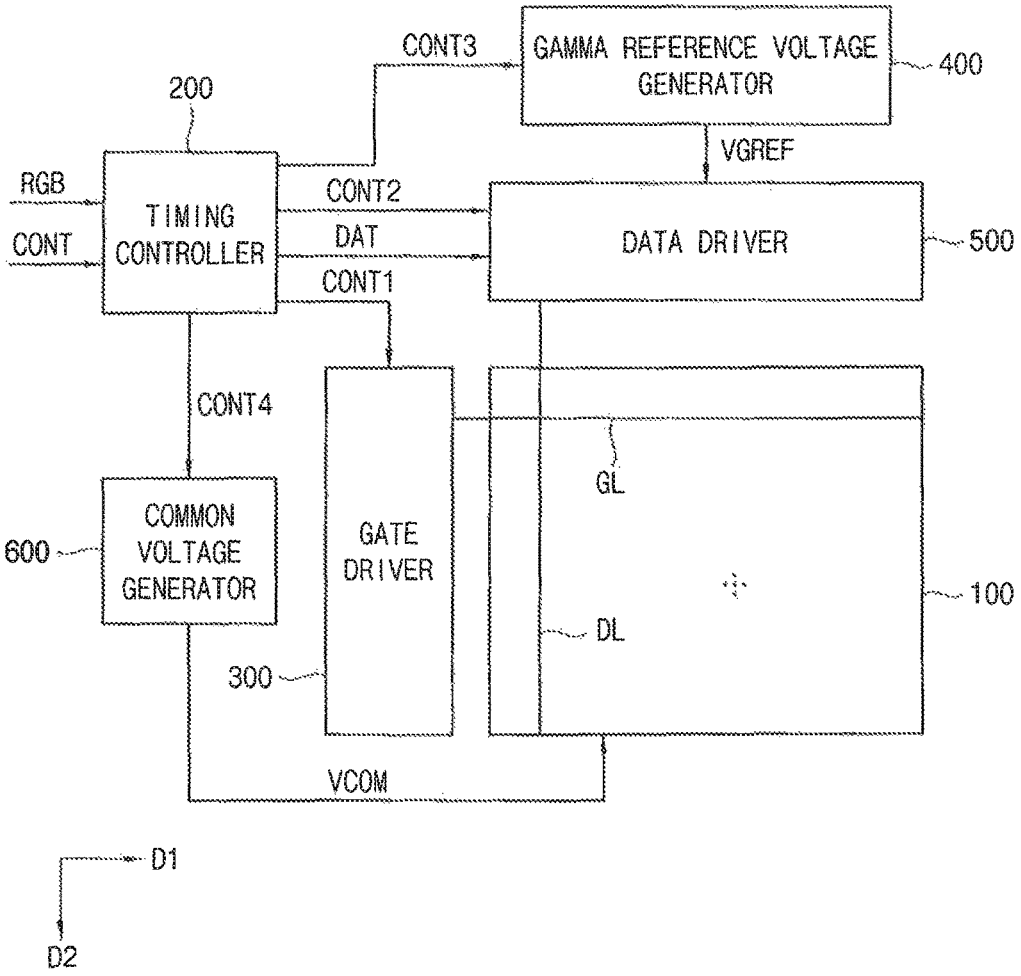
FIG. 1 is a block diagram illustrating a display apparatus according to an exemplary embodiment of the present inventive concept.

FIG. 1 is a block diagram illustrating a display apparatus according to an exemplary embodiment of the present inventive concept.

Referring to FIG. 1, the display apparatus includes a display panel 100 and a panel driver. The panel driver includes a timing controller 200, a gate driver 300, a gamma reference voltage generator 400, a data driver 500 and a common voltage generator 600. The elements of the display apparatus may be composed of circuits.

The display panel 100 includes a display region for displaying an image and a peripheral region adjacent to the display region.

The display panel 100 includes a plurality of gate lines GL, a plurality of data lines DL and a plurality of pixels electrically connected to the gate lines GL and the data lines DL. The gate lines GL extend in a first direction D1 and the data lines DL extend in a second direction D2 crossing the first direction D1.

In an exemplary embodiment of the present inventive concept, each of the pixels may include a switching element, a liquid crystal capacitor and a storage capacitor. The liquid crystal capacitor and the storage capacitor may be electrically connected to the switching element. The pixels may be arranged in a matrix configuration.

The timing controller 200 receives input image data RGB and an input control signal CONT from an external device. The input image data RGB may include red image data R, green image data G and blue image data B. The input control signal CONT may include a master clock signal and a data enable signal. The input control signal CONT may further include a vertical synchronizing signal and a horizontal synchronizing signal.

The timing controller 200 generates a first control signal CONT1, a second control signal CONT2, a third control signal CONT3, a fourth control signal CONT4 and a data signal DAT based on the input image data RGB and the input control signal CONT.

The timing controller 200 generates the first control signal CONT1 for controlling operations of the gate driver 300 based on the input control signal CONT, and outputs the first control signal CONT1 to the gate driver 300. The first control signal CONT1 may include a vertical start signal and a gate clock signal.

The timing controller 200 generates the second control signal CONT2 for controlling operations of the data driver 500 based on the input control signal CONT, and outputs the second control signal CONT2 to the data driver 500. The second control signal CONT2 may include a horizontal start signal and a load signal.

The timing controller 200 generates the data signal DAT based on the input image data RGB. The timing controller 200 outputs the data signal DAT to the data driver 500. The data signal DAT may be substantially the same as the input image data RGB or the data signal DAT may be compensated image data generated by compensating the input image data RGB. For example, the timing controller 200 may selectively perform an image quality compensation, a spot compensation, an adaptive color correction (ACC), and/or a dynamic capacitance compensation (DCC) on the input image data RGB to generate the data signal DAT.

The timing controller 200 generates the third control signal CONT3 for controlling operations of the gamma reference voltage generator 400 based on the input control signal CONT, and outputs the third control signal CONT3 to the gamma reference voltage generator 400.

The timing controller 200 generates the fourth control signal CONT4 for controlling operations of the common voltage generator 600 based on the input control signal CONT, and outputs the fourth control signal CONT4 to the common voltage generator 600.

The timing controller 200 will be explained in detail with reference to FIG. 2.

The gate driver 300 generates gate signals for driving the gate lines GL in response to the first control signal CONT1 provided from the timing controller 200. The gate driver 300 sequentially outputs the gate signals to the gate lines GL.

In an exemplary embodiment of the present inventive concept, the gate driver 300 may be directly mounted on the display panel 100, or may be connected to the display panel 100 as a tape carrier package (TCP) type. In addition, the gate driver 300 may be integrated on the peripheral region of the display panel 100.

The gamma reference voltage generator 400 generates a gamma reference voltage VGREF in response to the third control signal CONT3 provided from the timing controller 200. The gamma reference voltage generator 400 outputs the gamma reference voltage VGREF to the data driver 500. The level of the gamma reference voltage VGREF corresponds to grayscales of a plurality of pixel data included in the data signal DAT.

In an exemplary embodiment of the present inventive concept, the gamma reference voltage generator 400 may be disposed in the timing controller 200, or may be disposed in the data driver 500.

The data driver 500 receives the second control signal CONT2 and the data signal DAT from the timing controller 200, and receives the gamma reference voltage VGREF from the gamma reference voltage generator 400. The data driver 500 converts the data signal DAT to data voltages having analog levels based on the gamma reference voltage VGREF. The data driver 500 outputs the data voltages to the data lines DL.

In an exemplary embodiment of the present inventive concept, the data driver 500 may be directly mounted on the display panel 100, or may be connected to the display panel 100 as a TCP type. In addition, the data driver 500 may be integrated on the peripheral region of the display panel 100.

The common voltage generator 600 generates a common voltage VCOM in response to the fourth control signal CONT4 provided from the timing controller 200. The common voltage generator 600 outputs the common voltage VCOM to the display panel 100.

The common voltage generator 600 and the common voltage VCOM will be explained in detail with reference to FIGS. 2, 4, 5, 10, 12A, 12B, 12C and 13.

Figure 2:
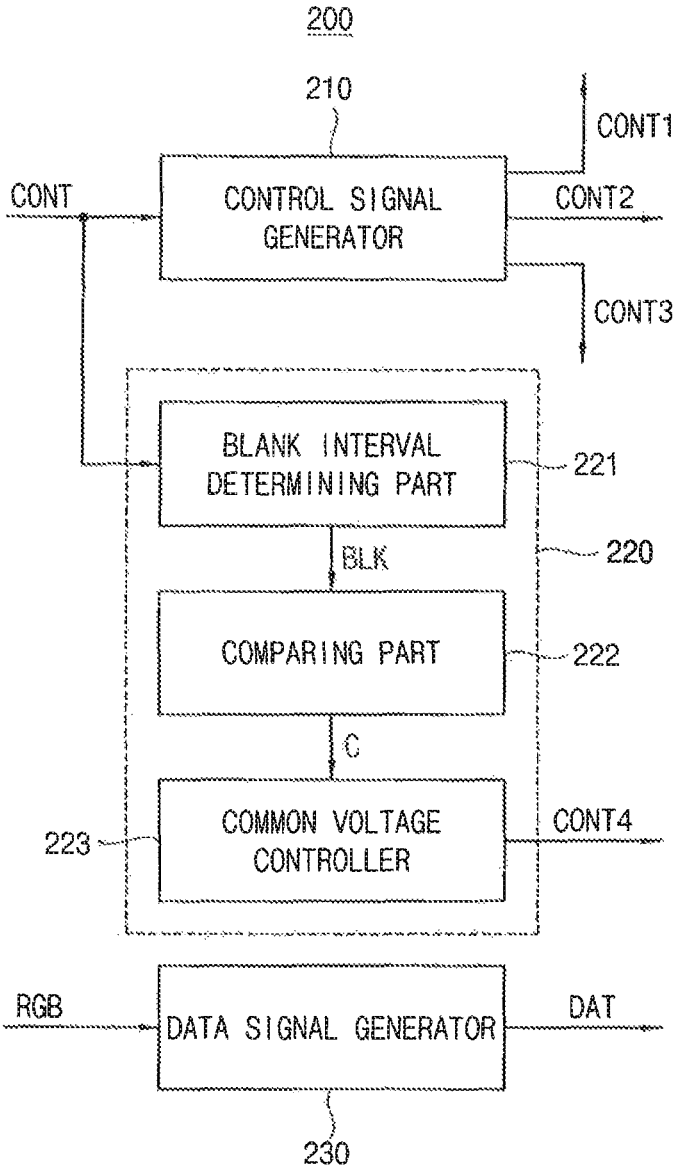
FIG. 2 is a block diagram illustrating a timing controller according to an exemplary embodiment of the present inventive concept.

FIG. 2 is a block diagram illustrating a timing controller according to an exemplary embodiment of the present inventive concept.

Referring to FIGS. 1 and 2, the timing controller 200 includes a control signal generator 210, a common voltage control group 220 and a data signal generator 230. The common voltage control group 220 includes a blank interval determining part 221, a comparing part 222 and a common voltage controller 223.

The control signal generator 210 generates the first through third control signals CONT1, CONT2, CONT3 based on the input control signal CONT. The control signal generator 210 outputs the first control signal CONT1 to the gate driver 300. The control signal generator 210 outputs the second control signal CONT2 to the data driver 500. The control signal generator 210 outputs the third control signal CONT3 to the gamma reference voltage generator 400.

The blank interval determining part 221 determines a duration BLK of a blank interval between a first frame and a second frame subsequent to the first frame. The blank interval may be a vertical blank interval between the first and second frames. The blank interval may be an extended blank interval including a frame masked by a Frame Masking Driving ("FMD") method. The blank interval determining part 221 outputs the duration BLK to the comparing part 222.

The timing controller 200 may further include an oscillator. The blank interval determining part 221 may include an oscillation clock counter.

The blank interval determining part 221 will be explained in detail with reference to FIG. 3. The FMD method will be explained in detail with reference to FIG. 9.

The comparing part 222 stores a first reference time. The comparing part 222 compares the duration BLK with the first reference time. The comparing part 222 determines an order relationship between the duration BLK and the first reference time. The comparing part 222 outputs a comparison signal C to the common voltage controller 223. The comparison signal C includes a comparison result between the duration BLK and the first reference time.

The comparing part 222 may further store a second reference time. The comparing part 222 may further compare the duration BLK with the second reference time. The comparing part 222 may further determine an order relationship between the duration BLK and the second reference time. The comparison signal C may further include a comparison result between the duration BLK and the second reference time.

The common voltage controller 223 generates the fourth control signal CONT4 based on the comparison signal C. The fourth control signal CONT4 controls the common voltage VCOM to be modulated and an average of the common voltage VCOM to be fixed during the blank interval when the duration BLK is longer than the first reference time. The fourth control signal CONT4 may control the common voltage VCOM to be fixed during the blank interval when the duration BLK is equal to or shorter than the first reference time. The common voltage controller 223 outputs the fourth control signal CONT4 to the common voltage generator 600.

The common voltage generator 600 generates a common voltage VCOM based on the fourth control signal CONT4. The common voltage VCOM is modulated during the blank interval while an average of the common voltage VCOM is fixed during the blank interval when the duration BLK is longer than the first reference time. For example, the common voltage VCOM may be swung between a first voltage level and a second voltage level during the blank interval. The common voltage VCOM may be fixed during the blank interval when the duration BLK is equal to or shorter than the first reference time. The common voltage generator 600 outputs the common voltage VCOM to the display panel 100.

The data signal generator 230 generates the data signal DAT based on the input image data RGB. The data signal generator 230 outputs the data signal DAT to the data driver 500.

The timing controller 200 may further include a frame masking part. The frame masking part may mask at least one frame between the first and second frames based on the input signal. For example, the frame masking part may mask one frame. In addition, the frame masking part may mask a plurality of frames. The blank interval between the first and second frames may be extended by the masking. For example, the blank interval determining part 221 may determine the extended blank interval.

Figure 3:
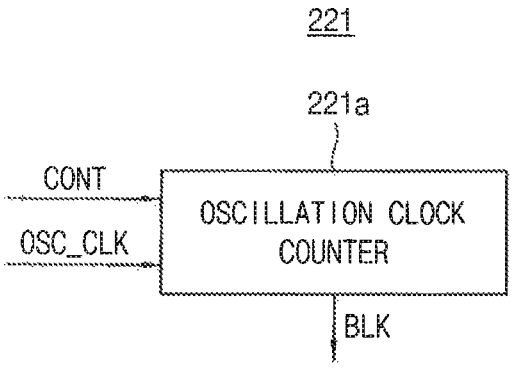
FIG. 3 is a block diagram illustrating a blank interval determining part included in a timing controller according to an exemplary embodiment of the present inventive concept.

FIG. 3 is a block diagram illustrating a blank interval determining part included in a timing controller according to an exemplary embodiment of the present inventive concept.

Referring to FIGS. 2 and 3, the timing controller 200 may include the oscillator. The blank interval determining part 221 may include an oscillation clock counter 221A.

The oscillator may generate an oscillation clock OSC_CLK. The oscillation clock OSC_CLK has a fixed interval. The oscillator may output the oscillation clock OSC_CLK to the oscillation clock counter 221A.

The oscillation clock counter 221A may count the oscillation clock OSC_CLK during the blank interval based on the input control signal CONT. The oscillation clock counter 221A may determine the duration BLK of the blank interval based on the number of counted oscillation clocks OSC_CLK.

Figure 4:
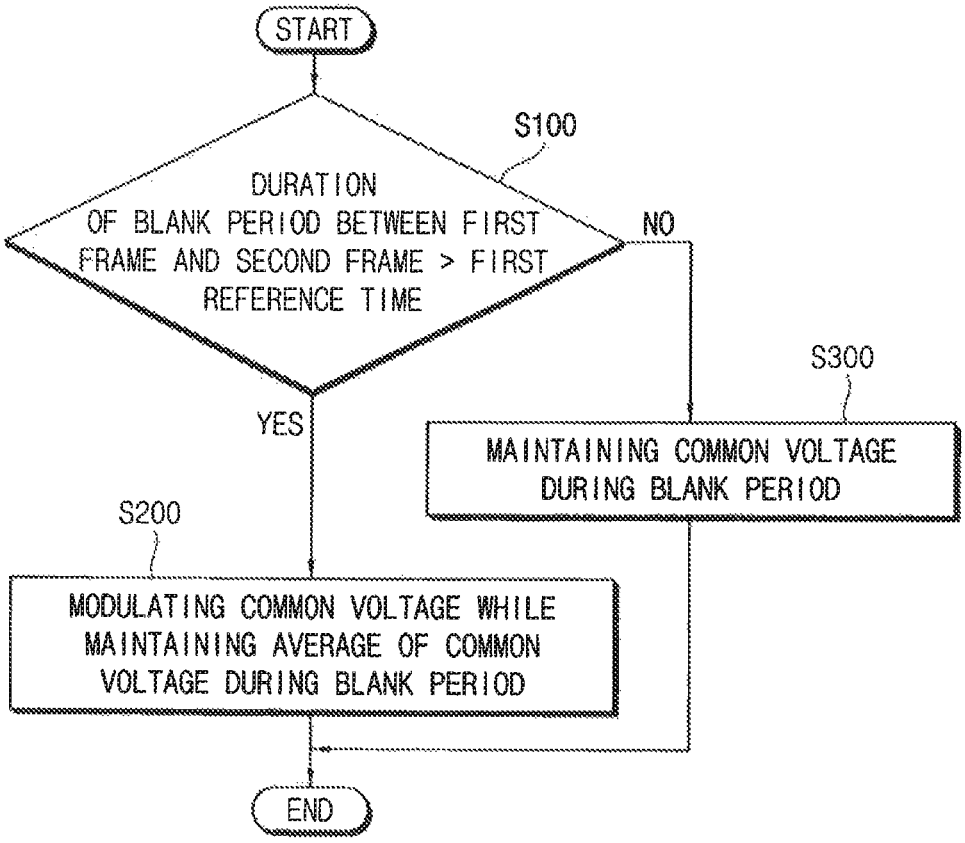
FIG. 4 is a flow chart illustrating a method of driving a display apparatus according to an exemplary embodiment of the present inventive concept.

FIG. 4 is a flow chart illustrating a method of driving a display apparatus according to an exemplary embodiment of the present inventive concept.

Referring to FIGS. 1 through 4, a method of driving the display apparatus includes determining the duration BLK of the blank interval between the first and second frames and comparing the duration BLK with the first reference time S100.

When the duration BLK is longer than the first reference time, the method includes modulating the common voltage VCOM during the blank interval and holding the average of the common voltage VCOM at a fixed level during the blank interval S200. For example, the common voltage VCOM may be swung between the first voltage level and the second voltage level during the blank interval.

When the duration BLK is equal to or shorter than the first reference time, the method includes holding the common voltage VCOM at a fixed level S300.

Figure 5:
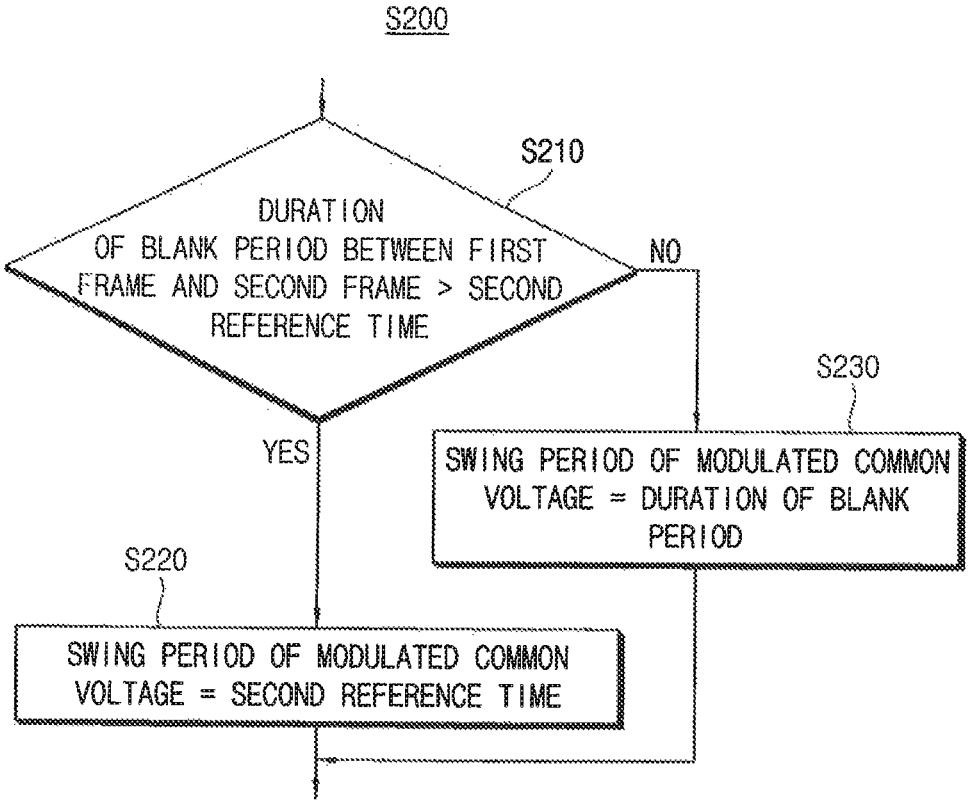
FIG. 5 is a flow chart illustrating a method of modulating a common voltage according to an exemplary embodiment of the present inventive concept.

FIG. 5 is a flow chart illustrating a method of modulating a common voltage according to an exemplary embodiment of the present inventive concept.

Referring to FIGS. 1 through 5, the method of driving the display apparatus includes comparing the duration BLK with the second reference time when the duration BLK is longer than the first reference time S210.

The common voltage VCOM may be swung between the first voltage level and the second voltage level during the blank interval when the duration BLK is longer than the first reference time S210. In this case, the duration BLK may be a multiple of a swinging period of the common voltage VCOM.

When the duration BLK is longer than the second reference time, the swinging period of the common voltage VCOM may be substantially the same as the second reference time S220. In this case, the duration BLK may be a multiple of the second reference time.

When the duration BLK is equal to or shorter than the second reference time, the swinging period of the common voltage VCOM may be substantially the same as the duration BLK S230.

Figure 6:
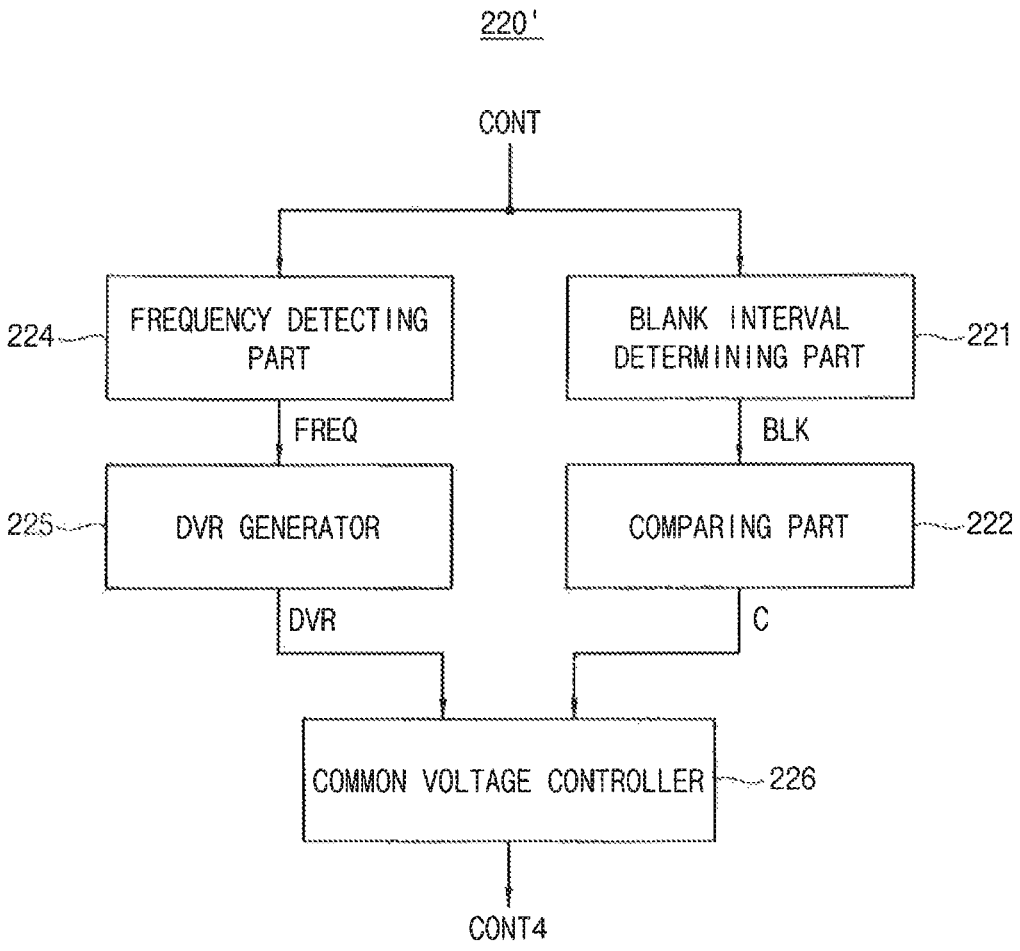
FIG. 6 is a block diagram illustrating a common voltage controlling group included in a timing controller according to an exemplary embodiment of the present inventive concept.

FIG. 6 is a block diagram illustrating a common voltage controlling group included in a timing controller according to an exemplary embodiment of the present inventive concept.

Referring to FIGS. 1, 2 and 6, the timing controller 200 may include a common voltage control group 220'.

The common voltage control group 220' includes the blank interval determining part 221, the comparing part 222 and the common voltage controller 223. The common voltage control group 220' may further include a frequency detecting part 224 and a DVR generator 225.

Any repetitive explanation concerning the blank interval determining part 221 and the comparing part 222 will be omitted.

The frequency detecting part 224 may detect a driving frequency FREQ of the display panel 100 based on the input control signal CONT. The frequency detecting part 224 may output the driving frequency FREQ to the DVR generator 225.

The frequency detecting part 224 will be explained in detail with reference to FIG. 7.

The DVR generator 225 generates a DVR value DVR according to the driving frequency FREQ. The DVR value DVR corresponds to a level of the common voltage VCOM. The DVR value DVR may determine the first voltage level and the second voltage level. The DVR generator 225 may output the DVR value DVR to the common voltage controller 223.

The DVR generator 225 may be explained in detail with reference to FIG. 8.

Figure 7:
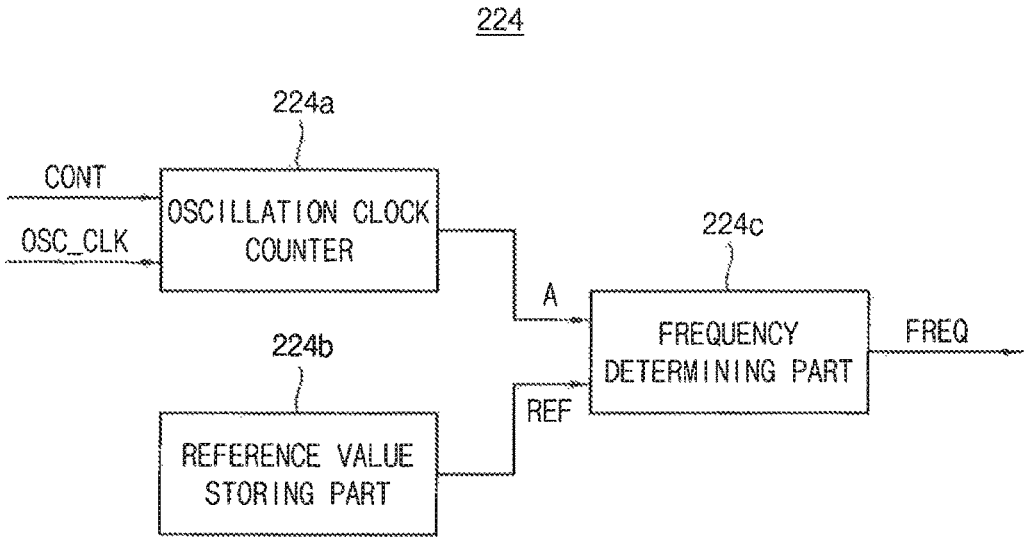
FIG. 7 is a block diagram illustrating a frequency detecting part included in a timing controller according to an exemplary embodiment of the present inventive concept.

FIG. 7 is a block diagram illustrating a frequency detecting part included in a timing controller according to an exemplary embodiment of the present inventive concept.

Referring to FIGS. 2, 6 and 7, the timing controller 200 may include the oscillator. The frequency detecting part 224 may include an oscillation clock counter 224A, a reference value storing part 224B and a frequency determining part 224C.

The oscillator may generate an oscillation clock OSC_CLK. The oscillation clock OSC_CLK has a fixed interval. The oscillator may output the oscillation clock OSC_CLK to the oscillation clock counter 224A.

The oscillation clock counter 224A may count the oscillation clock OSC_CLK based on the input control signal CONT. The oscillation clock counter 224A may generate an input signal count value A based on the counting of the oscillation clock OSC_CLK. The oscillation clock counter 224A may output the input signal count value A to the frequency determining part 224C.

The reference value storing part 224B may store a plurality of reference count values REF respectively corresponding to a plurality of driving frequencies. For example, the reference value storing part 224B may store the reference count values REF respectively corresponding to 60 Hz, 48 Hz and 40 Hz. The reference value storing part 224B may output the reference count values REF to the frequency determining part 224C.

The frequency determining part 224C may compare the input signal count value A with each of the reference count values REF. The frequency determining part 224C may find a reference count value REF that is substantially the same as or similar to the input signal count value A among the reference count values REF. The frequency determining part 224C may determine the driving frequency FREQ based on the reference count value REF that is substantially the same as or similar to the input signal count value A.

Figure 8:
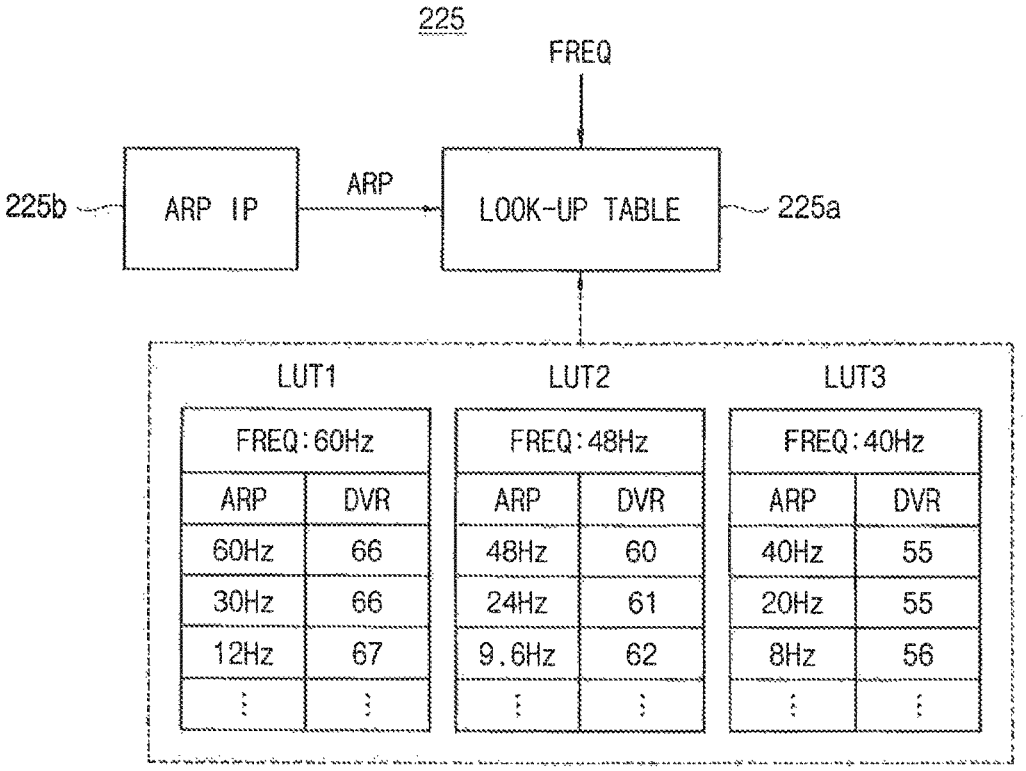
FIG. 8 is a block diagram illustrating a DVR generator included in a timing controller according to an exemplary embodiment of the present inventive concept.

FIG. 8 is a block diagram illustrating a DVR generator included in a timing controller according to an exemplary embodiment of the present inventive concept.

Referring to FIGS. 2, 6 and 8, the DVR generator 225 may include a look-up table 225A.

The look-up table 225A may store a plurality of DVR values DVR respectively corresponding to a plurality of driving frequencies. For example, the look-up table 225A may store the DVR values DVR respectively corresponding to 60 Hz, 48 Hz and 40 Hz. Each of the DVR values DVR corresponds to a level of the common voltage. Each of the DVR values DVR may determine the first voltage level and the second voltage level.

The frame masking part may mask at least one frame between the first and second frames based on the input signal. The frame masking part may convert the driving frequency FREQ to an ARP driving frequency ARP. For example, the frame masking part may convert the driving frequency of 60 Hz to the ARP driving frequency ARP of 30 Hz or 12 Hz. The frame masking part may convert the driving frequency of 48 Hz to the ARP driving frequency ARP of 24 Hz or 9.6 Hz. The frame masking part may convert the driving frequency of 40 Hz to the ARP driving frequency ARP of 20 Hz or 8 Hz.

The frame masking part will be explained in detail with reference to FIG. 9.

The DVR generator 225 may further include an ARP IP 225B. The ARP IP 225B may output the ARP driving frequency ARP to the look-up table 225A. For example, the look-up table 225A may find the DVR value DVR corresponding to the driving frequency FREQ and the ARP driving frequency ARP. For example, when the driving frequency FREQ is 60 Hz, and the ARP driving frequency is 30 Hz, the look-up table 225A may find the DVR value of 66 from LUT1. When the driving frequency FREQ is 48 Hz, and the ARP driving frequency is 9.6 Hz, the look-up table 225A may find the DVR value of 62 from LUT2. When the driving frequency FREQ is 40 Hz, and the ARP driving frequency is 20 Hz, the look-up table 225A may find the DVR value of 55 from LUT3.

The DVR generator 225 may output the DVR value DVR to the common voltage controller 223.

Figure 9:
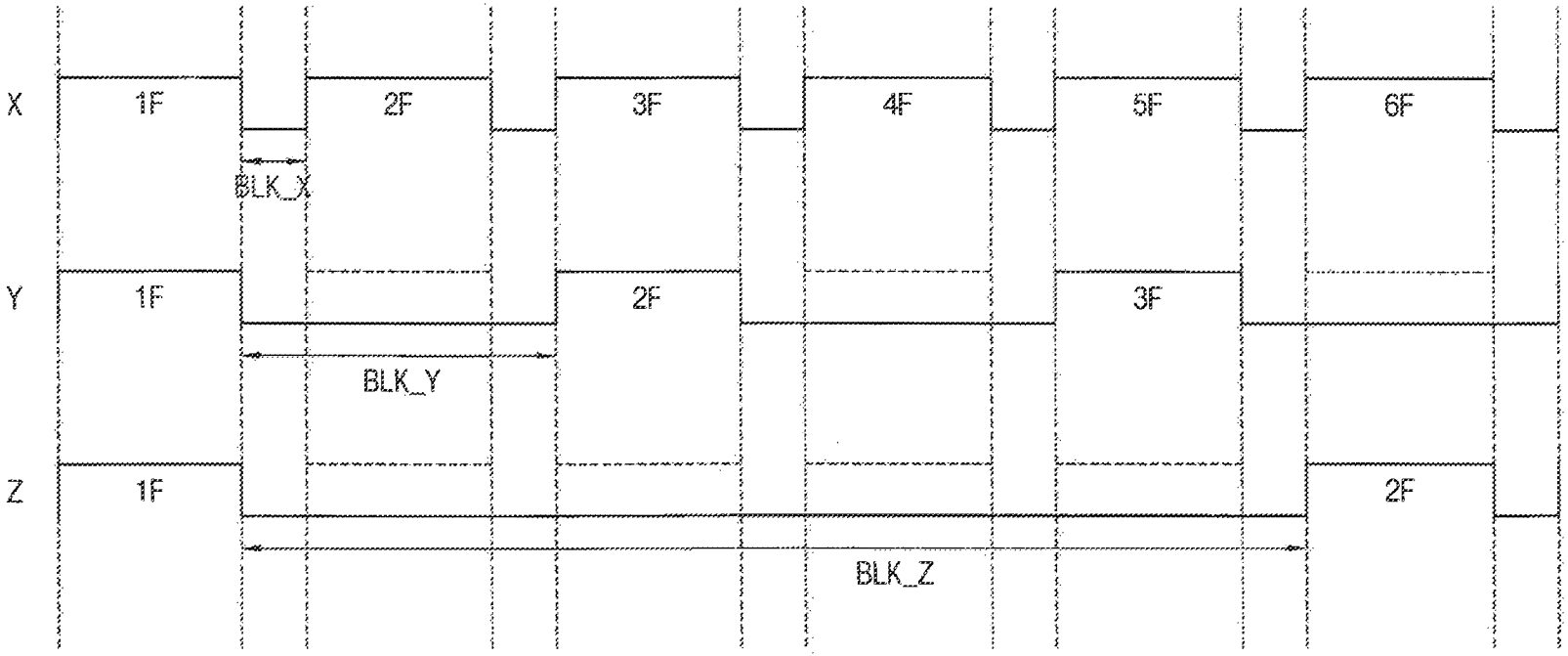
FIG. 9 is a diagram illustrating a method of driving a display apparatus by a Frame Masking Driving method according to an exemplary embodiment of the present inventive concept.

FIG. 9 is a diagram illustrating a method of driving a display apparatus by an FMD method according to an exemplary embodiment of the present inventive concept.

Referring to FIGS. 2, 6, 8 and 9, the timing controller 200 may include the frame masking part. The frame masking part may mask a frame based on the FMD method.

The FMD method is not applied to a first image X. The first image X may be displayed with k Hz of driving frequency FREQ. The k may be one of 60, 48 and 40. The first image X includes a first frame 1F and a second frame 2F subsequent to the first frame 1F. The first image X includes a first blank interval having a first duration BLK_X between the first frame 1F and the second frame 2F. The first image X may further include third, fourth, fifth and sixth frames 3F, 4F, 5F, 6F. For example, the blank interval determining part 221 may determine the first duration BLK_X.

The FMD method is applied to a second image Y. The second image Y may be displayed with k/2 Hz of an ARP driving frequency ARP. The second image Y includes a first frame 1F and a second frame 2F subsequent to the first frame 1F. One frame is masked between the first frame 1F and the second frame 2F in the second image Y. The second image Y includes a second blank interval having a second duration BLK_Y between the first frame 1F and the second frame 2F. The second blank interval is extended compared to the first blank interval. In other words, the second blank interval is longer than the first blank interval. The second duration BLK_Y is longer than the first duration BLK_X. For example, the blank interval determining part 221 may determine the second duration time BLK_Y. The ARP IP 225B may output k/2 Hz of an ARP driving frequency ARP to the look-up table 225A.

The FMD method is applied to a third image Z. The third image Z may be displayed with k/5 Hz of an ARP driving frequency ARP. The third image Z includes a first frame 1F and a second frame 2F subsequent to the first frame 1F. Four frames are masked between the first frame 1F and the second frame 2F in the third image Z. The third image Z includes a third blank interval having a third duration BLK_Z between the first frame 1F and the second frame 2F. The third blank interval is extended compared to the first and second blank intervals. In other words, the third blank interval is longer than both of the first and second blank intervals. The third duration BLK_Z is longer than the first and second durations BLK_X, BLK_Y. For example, the blank interval determining part 221 may determine the third duration BLK_Z. The ARP IP 225B may output k/5 Hz of an ARP driving frequency ARP to the look-up table 225A.

Hereinafter, exemplary embodiments of the present inventive concept will be explained based on images where the FMD method is applied with reference to FIGS. 11, 12A through 12C and 13. However, the exemplary embodiments of the present inventive concept are not limited to the FMD method.

Figure 10:
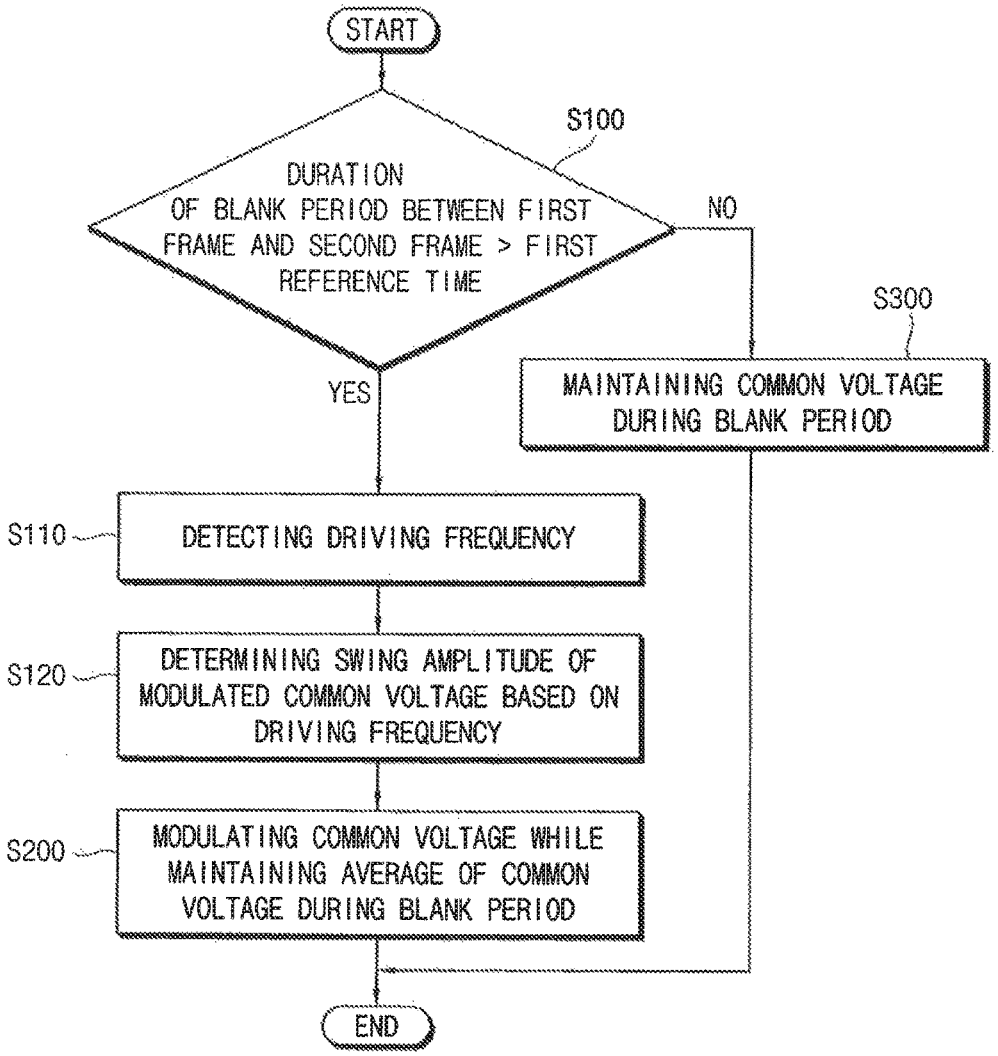
FIG. 10 is a flow chart illustrating a method of driving a display apparatus according to an exemplary embodiment of the present inventive concept.

FIG. 10 is a flow chart illustrating a method of driving a display apparatus according to an exemplary embodiment of the present inventive concept.

Referring to FIGS. 1, 2, 6 through 8 and 10, a method of driving the display apparatus includes determining the duration BLK of the blank interval between the first and second frames and comparing the duration BLK with the first reference time S100.

When the duration BLK is longer than the first reference time, the method may include detecting the driving frequency FREQ S110. For example, the method may include comparing the input signal count value A where the oscillation clock OSC_CLK is counted with each of the reference count values REF to detect the driving frequency FREQ.

The method may include determining the DVR value DVR according to the driving frequency FREQ. The DVR value DVR may determine the first voltage level and the second voltage level. The common voltage VCOM may be swung between the first voltage level and the second voltage level during the blank interval. A swinging amplitude of the common voltage VCOM may be a difference of the first voltage level and the average of the common voltage VCOM. The method may include determining the swinging amplitude according to the driving frequency FREQ S120. For example, the method may determine the swinging amplitude considering the ARP driving frequency ARP according to the FMD method.

The method includes modulating the common voltage VCOM during the blank interval and holding the average of the common voltage VCOM at a fixed level during the blank interval S200. For example, the common voltage VCOM may be swung between the first voltage level and the second voltage level during the blank interval.

When the duration BLK is equal to or shorter than the first reference time, the method includes holding the common voltage VCOM at a fixed level S300.

Figure 11:
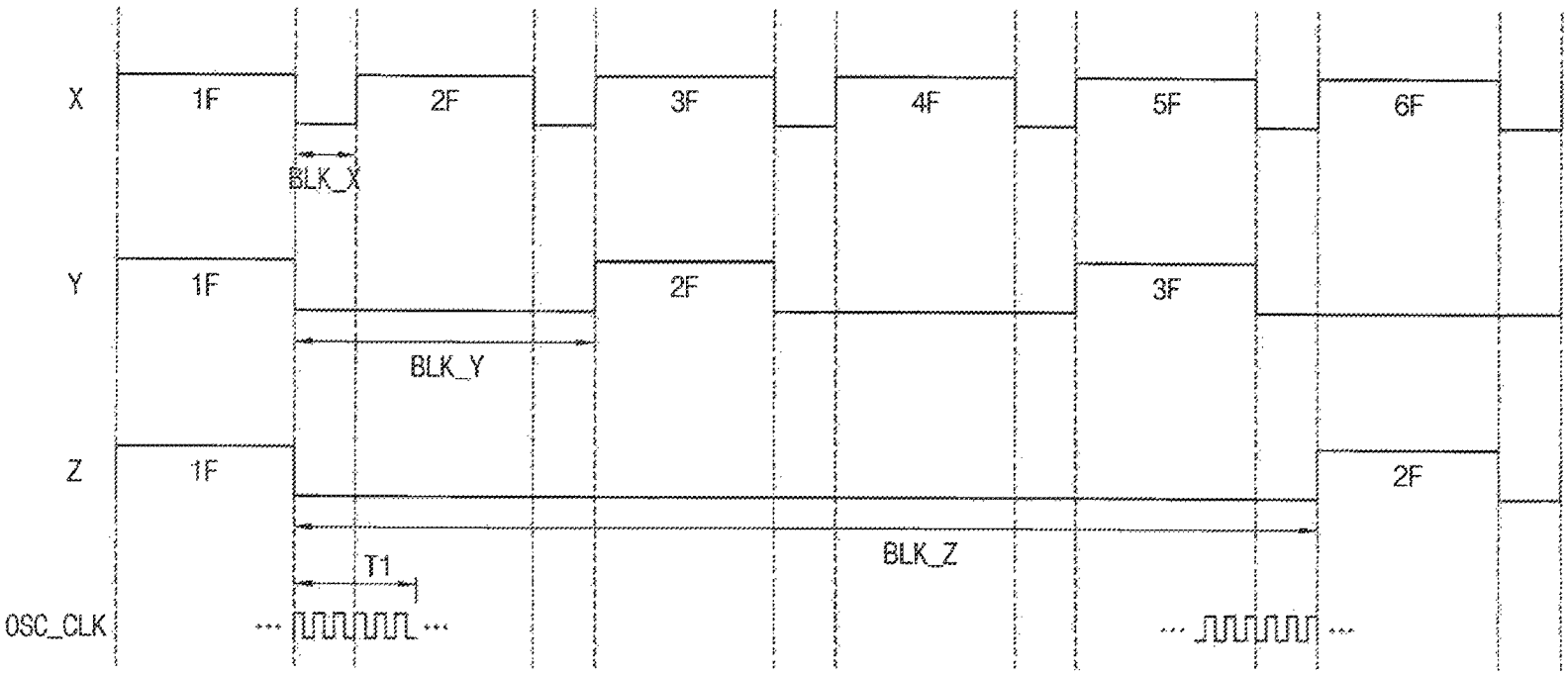
FIG. 11 is a diagram illustrating operations of a blank interval determining part included in a timing controller according to an exemplary embodiment of the present inventive concept.

FIG. 11 is a diagram illustrating operations of a blank interval determining part included in a timing controller according to an exemplary embodiment of the present inventive concept.

Referring to FIGS. 2, 3 and 11, the blank interval determining part 221 determines the duration BLK of the blank interval between the first frame and the second frame. The blank interval determining part 221 determines a first duration BLK_X of a first blank interval between a first frame 1F and a second frame 2F in a first image X. The blank interval determining part 221 determines a second duration BLK_Y of a second blank interval between a first frame 1F and a second frame 2F in a second image Y. The blank interval determining part 221 determines a third duration BLK_Z of a third blank interval between a first frame 1F and a second frame 2F in a third image Z.

The timing controller 200 may include the oscillator. The oscillator may generate the oscillation clock OSC_CLK. The oscillation clock OSC_CLK has a fixed interval.

The blank interval determining part 221 may include the oscillation clock counter 221A. The oscillation clock counter 221A may count the oscillation clock OSC_CLK during the first blank interval in the first image X. The oscillation clock counter 221A may determine the first duration BLK_X based on a first number of the oscillation clocks OSC_CLK counted during the first blank interval. The oscillation clock counter 221A may count the oscillation clock OSC_CLK during the second blank interval in the second image Y. The oscillation clock counter 221A may determine the second duration BLK_Y based on a second number of the oscillation clocks OSC_CLK counted during the second blank interval. The oscillation clock counter 221A may count the oscillation clock OSC_CLK during the third blank interval in the third image Z. The oscillation clock counter 221A may determine the third duration BLK_Z based on a third number of the oscillation clocks OSC_CLK counted during the third blank interval.

The comparing part 222 stores a first reference time T1. The comparing part 222 compares the first duration BLK_X with the first reference time T1 in the first image X. The comparing part 222 determines an order relationship between the first duration BLK_X and the first reference time T1 in the first image X. For example, the first duration BLK_X may be shorter than the first reference time T1. The comparing part 222 compares the second duration BLK_Y with the first reference time T1 in the second image Y. The comparing part 222 determines an order relationship between the second duration BLK_Y and the first reference time T1 in the second image X. For example, the second duration BLK_Y may be longer than the first reference time T1. The comparing part 222 compares the third duration BLK_Z with the first reference time T1 in the third image Z. The comparing part 222 determines an order relationship between the third duration BLK_Z and the first reference time T1 in the third image Z. For example, the third duration BLK_Z may be longer than the first reference time T1. The comparing part 222 outputs the comparison signal C including a comparison result between the first, second and third duration times BLK_X, BLK_Y, BLK_Z and the first reference time T1 to the common voltage controller 223.

FIGS. 12A, 12B, 12C and 13 are diagrams illustrating a common voltage outputted from a common voltage generator included in a display apparatus according to an exemplary embodiment of the present inventive concept.

Referring to FIGS. 1, 2, 6, 11 and 12A, the common voltage controller 223 generates the fourth control signal CONT4 based on the comparison signal C. The common voltage generator 600 may generate the common voltage VCOM based on the fourth control signal CONT4.

The common voltage controller 223 generates the fourth control signal CONT4 for controlling the common voltage VCOM to be modulated and an average of the common voltage VCOM to be fixed during the blank interval when the duration BLK is longer than the first reference time T1 based on the comparison signal C. For example, the common voltage generator 600 may generate the common voltage VCOM modulated during the blank interval while the average of the common voltage VCOM is fixed during the blank interval based on the fourth control signal CONT4. The common voltage VCOM may also be swung between a first voltage level and a second voltage level during the blank interval. For example, the duration BLK may be a multiple of a swinging period of the common voltage VCOM.

The comparing part 222 may further include a second reference time T2. The comparing part 222 may compare the duration BLK with the second reference time T2 when the duration BLK is longer than the first reference time T1. The comparing part 222 may determine an order relationship between the duration BLK and the second reference time T2. The comparison signal C may further include a comparison result between the duration BLK and the second reference time T2.

The common voltage controller 223 may generate the fourth control signal CONT4 for controlling the swinging period to be substantially the same as the duration BLK when duration BLK is longer than the first reference time T1 and equal to or shorter than the second reference time T2 based on the comparison signal C. For example, the common voltage generator 600 may generate the common voltage VCOM where a swinging period is substantially the same as the duration BLK based on the fourth control signal CONT4.

The common voltage controller 223 may generate the fourth control signal CONT4 for controlling the swinging period to be substantially the same as the second reference time T2 when duration BLK is longer than the second reference time T2 based on the comparison signal C. For example, the common voltage generator 600 may generate the common voltage VCOM where a swinging period is substantially the same as the second reference time T2 based on the fourth control signal CONT4. For example, the duration BLK may be a multiple of the second reference time T2.

The frequency detecting part 224 may detect a driving frequency FREQ of the display panel 100. The DVR generator 225 generates the DVR value DVR according to the driving frequency FREQ or the ARP driving frequency ARP. The common voltage controller 223 may determine the first voltage level and the second voltage level based on the DVR value DVR.

The common voltage controller 223 may generate the fourth control signal CONT4 for controlling the common voltage VCOM to be fixed during the blank interval when duration time BLK is equal to or shorter than the first reference time T1 based on the comparison signal C. For example, the common voltage generator 600 may generate the common voltage VCOM that is fixed during the blank interval based on the fourth control signal CONT4.

As an example case, the first duration BLK_X is equal to or shorter than the first reference time T1 in the first image X. In this case, the common voltage controller 223 may generate the fourth control signal CONT4 for controlling a first common voltage VCOM_X to be fixed during the first blank interval based on the comparison signal C. In this case, the common voltage generator 600 may generate the first common voltage VCOM_X that is fixed during first blank interval based on the fourth control signal CONT4.

As an example case, the second duration BLK_Y is longer than the first reference time T1 and equal to or shorter than the second reference time T2 in the second image Y. In this case, the common voltage controller 223 may generate the fourth control signal CONT4 for controlling a second common voltage VCOM_Y to be modulated, an average of the second common voltage VCOM_Y to be fixed during the second blank interval and a second swinging period T_Y of the second common voltage VCOM_Y to be substantially the same as the second duration time BLK_Y based on the comparison signal C. In this case, the frequency detecting part 224 may detect a driving frequency FREQ of the second image Y. The DVR generator 225 may generate the DVR value DVR according to the driving frequency FREQ or an ARP driving frequency ARP of the second image Y. The common voltage controller 223 may determine the first voltage level V1_Y and the second voltage level V2_Y based on the DVR value DVR. In this case, the common voltage generator 600 may generate the second common voltage VCOM_Y that is swung between the first voltage level V1_Y and the second voltage level V2_Y during the second blank interval and that has the second swinging period T_Y substantially the same as the second duration BLK_Y based on the fourth control signal CONT4.

As an example case, the third duration BLK_Z is longer than the second reference time T2 in the third image Z. In this case, the common voltage controller 223 may generate the fourth control signal CONT4 for controlling a third common voltage VCOM_Z to be modulated, an average of the third common voltage VCOM_Z to be fixed during the third blank interval and a third swinging period T_Z of the third common voltage VCOM_Z to be substantially the same as the second reference time T2 based on the comparison signal C. In this case, the third duration time BLK_Z may be a multiple of the second reference time T2. In this case, the frequency detecting part 224 may detect a driving frequency FREQ of the third image Z. The DVR generator 225 may generate the DVR value DVR according to the driving frequency FREQ or an ARP driving frequency ARP of the third image Z. The common voltage controller 223 may determine the first voltage level V1_Z and the second voltage level V2_Z based on the DVR value DVR. In this case, the common voltage generator 600 may generate the third common voltage VCOM_Z that is swung between the first voltage level V1_Z and the second voltage level V2_Z during the third blank interval and that has the third swinging period T_Z substantially the same as the second reference time T2 based on the fourth control signal CONT4.

Figure 12A:
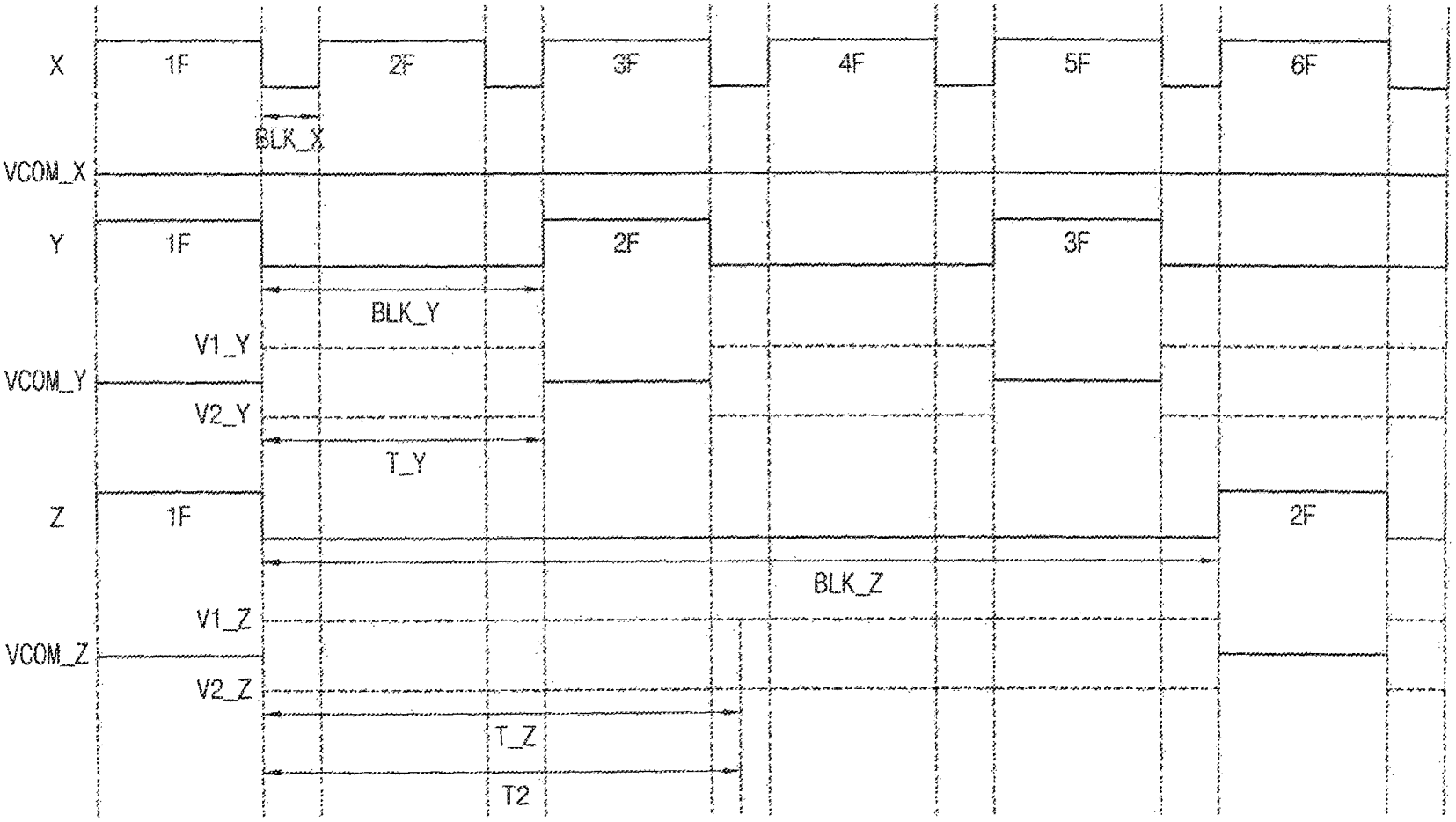
FIGS. 12A, 12B, 12C and 13 are diagrams illustrating a common voltage outputted from a common voltage generator included in a display apparatus according to an exemplary embodiment of the present inventive concept.
Figure 12B:
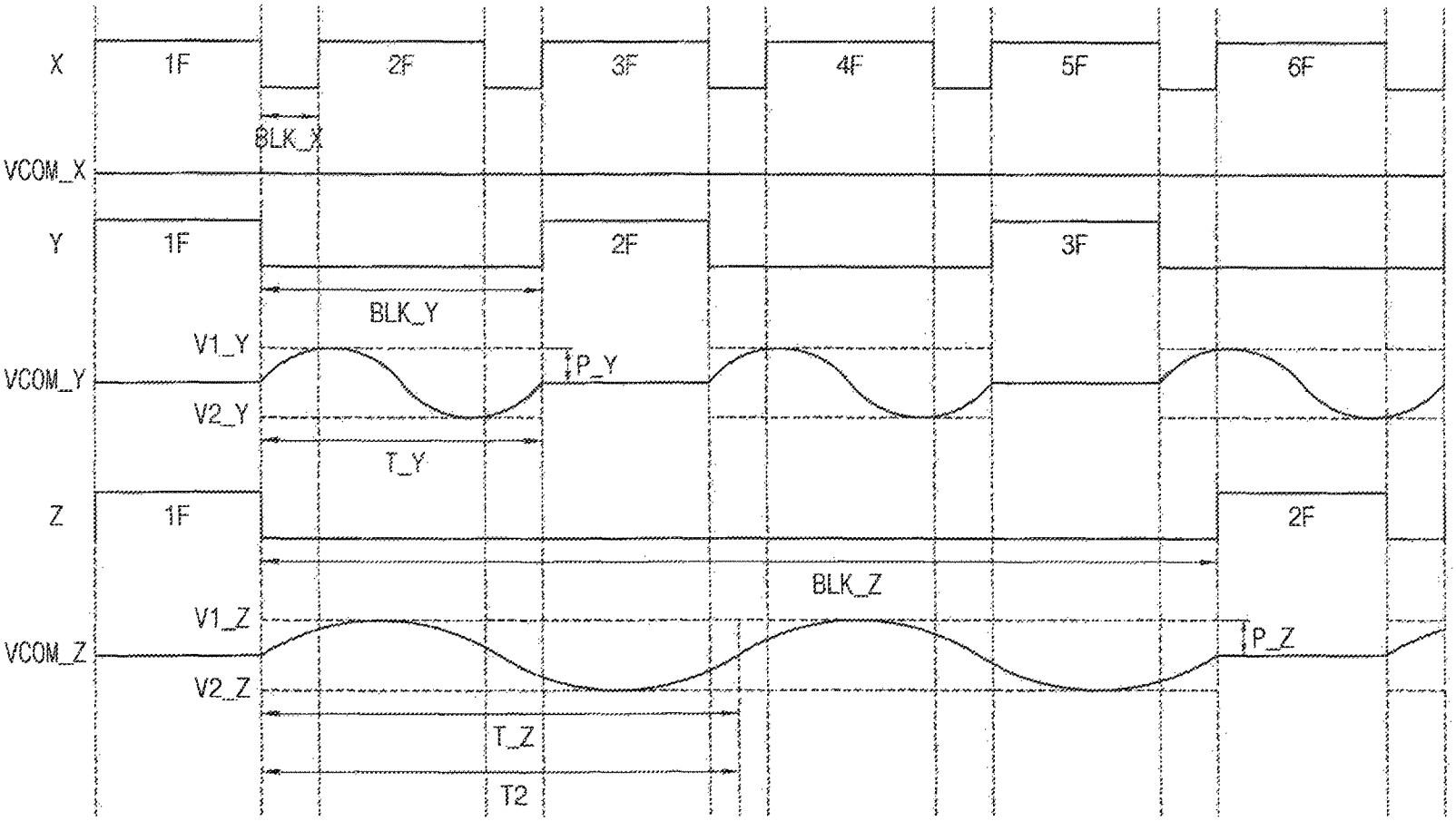

Referring to FIGS. 12A and 12B, the second common voltage VCOM_Y may be modulated and may have a first sine wave during the second blank interval in the second image Y. A period of the first sine wave may be substantially the same as the second swinging period T_Y. An amplitude P_Y of the first sine wave may be substantially the same as a difference of the first voltage level V1_Y and an average of the second common voltage VCOM_Y.

The third common voltage VCOM_Z may be modulated and may have a second sine wave during the third blank interval in the third image Z. A period of the second sine wave may be substantially the same as the third swinging period T_Z. An amplitude P_Z of the second sine wave may be substantially the same as a difference of the first voltage level V1_Z and an average of the third common voltage VCOM_Z.

According to the present exemplary embodiment, a common voltage VCOM is slowly modulated according to a sine wave while an average of the common voltage VCOM is fixed so that flickers caused by a rapid modulation of the common voltage VCOM can be reduced.

Figure 12C:
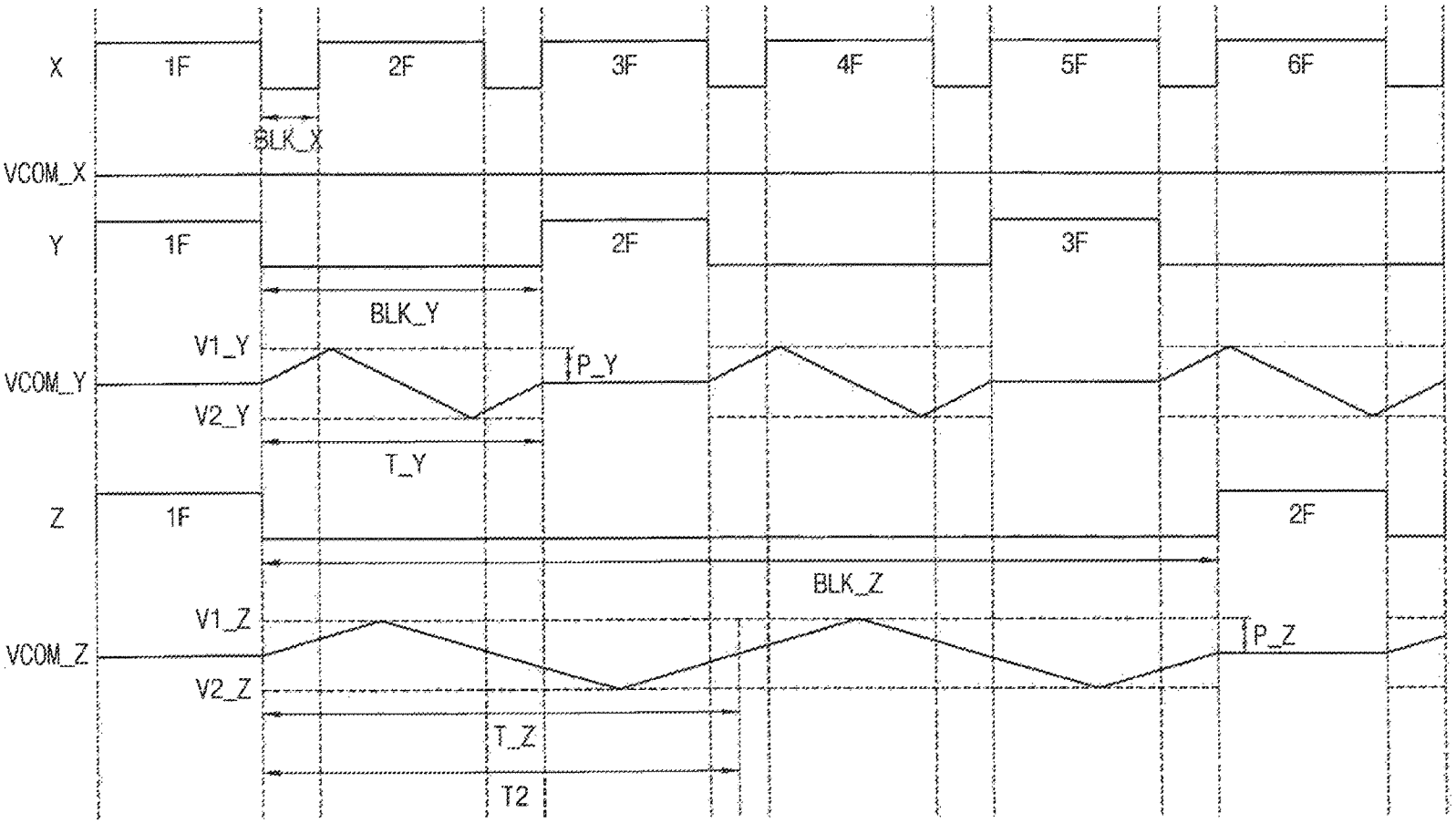
Figure 13:
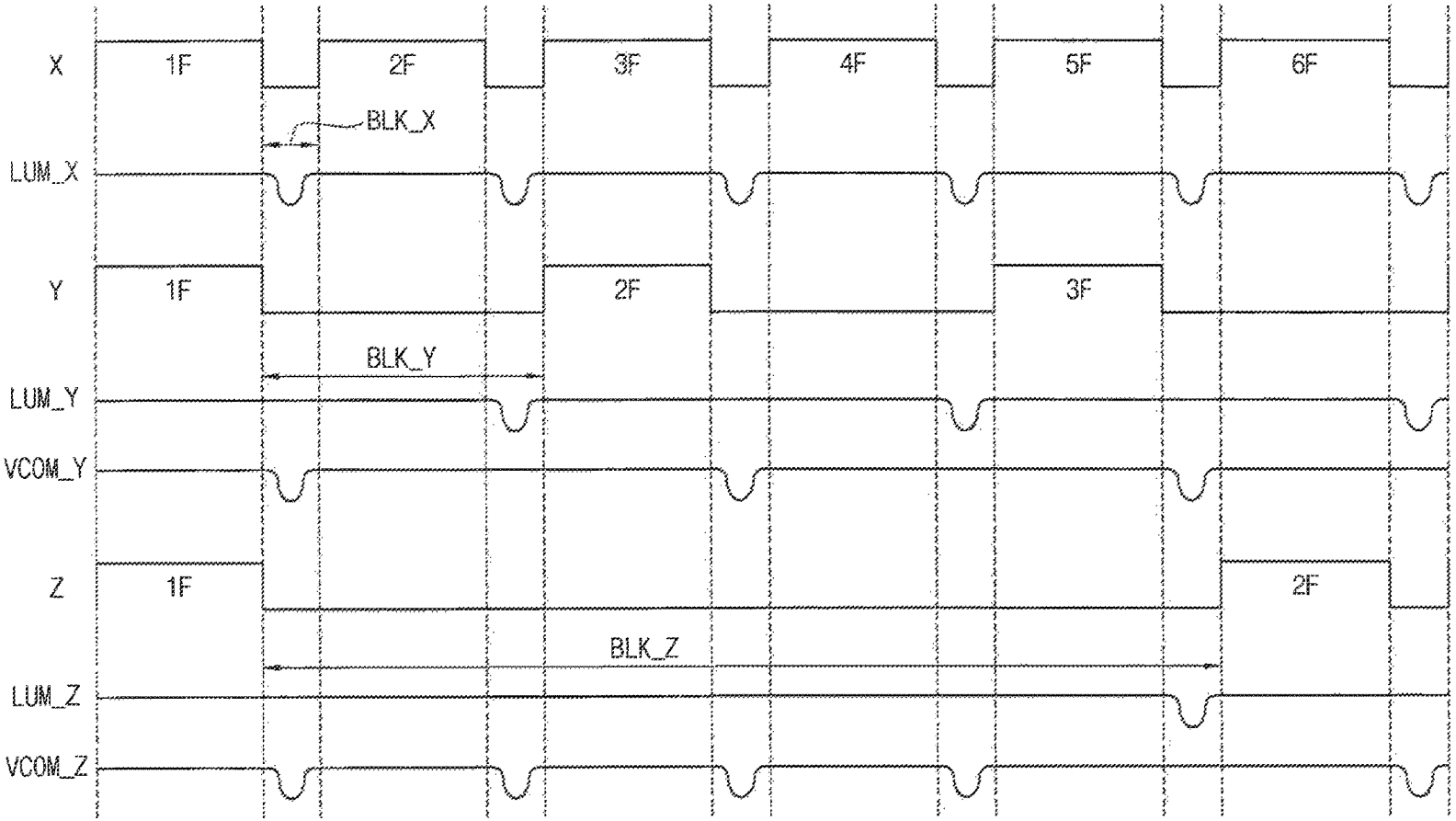

Referring to FIGS. 12A and 12C, the second common voltage VCOM_Y may be modulated and may have a first triangle wave during the second blank interval in the second image Y. A period of the first triangle wave may be substantially the same as the second swinging period T_Y. An amplitude P_Y of the first triangle wave may be substantially the same as a difference of the first voltage level V1_Y and an average of the second common voltage VCOM_Y.

The third common voltage VCOM_Z may be modulated and may have a second triangle wave during the third blank interval in the third image Z. A period of the second triangle wave may be substantially the same as the third swinging period T_Z. An amplitude P_Z of the second triangle wave may be substantially the same as a difference of the first voltage level V1_Z and an average of the third common voltage VCOM_Z.

Referring to FIGS. 1, 2, 11 and 13, a luminance is modulated before beginning of every frame in a first luminance LUM_X of the first image X, a second luminance LUM_Y of the second image Y and a third luminance LUM_Z of the third image Z.

The blank interval determining part 221 determines the first duration BLK_X of the first blank interval between the first frame 1F and the second frame 2F in the first image X. The blank interval determining part 221 determines the second duration BLK_Y of the second blank interval between the first frame 1F and the second frame 2F in the second image Y. The blank interval determining part 221 determines the third duration BLK_Z of the third blank interval between the first frame 1F and the second frame 2F in the third image Z.

The comparing part 222 compares the first duration BLK_X with the first reference time T1 in the first image X. The comparing part 222 compares the second duration BLK_Y with the first reference time T1 in the second image Y. The comparing part 222 compares the third duration BLK_Z with the first reference time T1 in the third image Z.

The common voltage generator 600 may apply a plurality of common voltage pulses to the common voltage VCOM with a fixed interval during the blank interval when the duration BLK is longer than the first reference time T1. The common voltage generator 600 may hold the common voltage VCOM at a fixed level during the blank interval when the duration BLK is equal to or shorter than the first reference time T1.

For example, the common voltage generator 600 may hold the first common voltage VCOM_X at a fixed level because the first duration BLK_X is equal to or shorter than the first reference time T1 in the first image X.

For example, the common voltage generator 600 may apply a plurality of second common voltage pulses to the second common voltage VCOM_Y because the second duration BLK_Y is longer than the first reference time T1. For example, the second common voltage pulses may correspond to the pulses of the second luminance LUM_Y so that an interval of the second common voltage pulses is substantially the same as an interval of the pulses of the first luminance LUM_X.

For example, the common voltage generator 600 may apply a plurality of third common voltage pulses to the third common voltage VCOM_Z because the third duration BLK_Z is longer than the first reference time T1. For example, the third common voltage pulses may correspond to the pulses of the third luminance LUM_Z so that an interval of the third common voltage pulses is substantially the same as an interval of the pulses of the first luminance LUM_X.

According to the present exemplary embodiment, a plurality of common voltage pulses is applied to a common voltage in low frequency driving to narrow an interval between each pulse.

In the above described exemplary embodiments of the present inventive concept, a common voltage is variously modulated during an extended blank interval according to a driving frequency so that flickers and afterimages are reduced. Thus, display quality of the display panel can be increased.

The above described exemplary embodiments of the present inventive concept may be used in a display apparatus and/or a system including the display apparatus, such as a mobile phone, a smart phone, a personal digital assistant (PDA), a portable media player (PMP), a digital camera, a digital television, a set-top box, a music player, a portable game console, a navigation device, a personal computer (PC), a server computer, a workstation, a tablet computer, a laptop computer, a smart card, a printer, etc.

While the present inventive concept has been particularly shown and described with reference to exemplary embodiments thereof, it will be apparent to those of ordinary skill in the art that various changes in form and detail may be made thereto without departing from the spirit and scope of the present inventive concept as defined by the following claims.

What is claimed is:

1. A method of driving a display apparatus, the method comprising: determining a duration of a blank interval between a first frame and a second frame, wherein the second frame is subsequent to the first frame and determining the duration of the blank interval comprises counting an oscillation clock during the blank interval; and modulating a common voltage during the blank interval when the duration is longer than a first reference time, wherein an average of the common voltage is fixed during the blank interval; and masking at least one frame between the first and second frames in response to an input signal to extend the blank interval.

2. The method of claim 1, wherein modulating the common voltage comprises:

swinging the common voltage between a first voltage level and a second voltage level.

3. The method of claim 2, wherein the duration is a multiple of a swinging period of the modulated common voltage.

4. The method of claim 2, wherein a swinging period of the modulated common voltage is substantially the same as the duration when the duration is longer than the first reference time and equal to or shorter than a second reference time, and wherein the swinging period is substantially the same as the second reference time when the duration is longer than the second reference time.

5. The method of claim 4, wherein the duration is a multiple of the second reference time.

6. The method of claim 2, further comprising:

detecting a driving frequency of a display panel; and determining the first and second voltage levels in response to the driving frequency.

7. The method of claim 6, wherein a swinging amplitude of the modulated common voltage is substantially the same as a difference of the average of the common voltage and the first voltage level.

8. The method of claim 6, wherein detecting the driving frequency comprises:

comparing an input signal count value with a plurality of reference count values, wherein the input signal count value is generated by counting the oscillation clock in response to an input signal.

9. The method of claim 6, wherein determining the first and second voltage levels comprises:

referring to a look-up table where a plurality of first values respectively corresponding to a plurality of driving frequencies is stored.

10. The method of claim 1, wherein modulating the common voltage comprises:

modulating the common voltage to have a sine wave during the blank interval.

11. The method of claim 1, wherein modulating the common voltage comprises:

modulating the common voltage to have a triangle wave during the blank interval.

12. The method of claim 1, further comprising:

masking at least one frame between the first and second frames in response to an input signal to extend the blank interval.

13. The method of claim 12, wherein determining the duration comprises:

determining a duration of the extended blank interval.

14. The method of claim 1, further comprising:

holding the common voltage at a fixed level during the blank interval when the duration is equal to or shorter than the first reference time.

15. A display apparatus, comprising: a timing controller comprising: a blank interval determining circuit configured to determine a duration of a blank interval between a first frame and a second frame, wherein the second frame is subsequent to the first frame, and the blank interval determining circuit includes an oscillation clock counter configured to count an oscillation clock during the blank interval; a frame masking circuit configured to mask at least one frame between the first and second frames in response to an input signal to extend the blank interval; a comparing circuit configured to compare the duration with a first reference time; and a common voltage controller configured to generate a first common voltage control signal when the duration is longer than the first reference time; a common voltage generator configured to generate a first common voltage in response to the first common voltage control signal, wherein the first common voltage is modulated during the blank interval, and an average of the first common voltage is fixed during the blank interval; and a display panel configured to be driven in response to the first common voltage.

16. The display apparatus of claim 15, wherein the first common voltage is swung between a first voltage level and a second voltage level.

17. The display apparatus of claim 16, wherein the duration is a multiple of a swinging period of the first common voltage.

18. The display apparatus of claim 16, wherein the comparing circuit is configured to compare the duration with a second reference time, and wherein a swinging period of the first common voltage is substantially the same as the duration when the duration is longer than the first reference time and equal to or shorter than the second reference time, and the swinging period is substantially the same as the second reference time when the duration is longer than the second reference time.

19. The display apparatus of claim 16, wherein the timing controller further comprises:

a frequency detecting circuit configured to detect a driving frequency of the display panel; and a first generator configured to generate a first value that determines the first and second voltage levels in response to the driving frequency.

20. The display apparatus of claim 19, wherein the frequency detecting circuit comprises:

an oscillation clock counter configured to count the oscillation clock in response to an input signal to generate an input signal count value;

a reference value storing circuit configured to store a plurality of reference count values respectively corresponding to a plurality of driving frequencies; and a frequency determining circuit configured to compare the input signal count value with each of the reference count values to determine the driving frequency of the display panel.

21. The display apparatus of claim 19, wherein the first generator comprises:

a look-up table storing a plurality of first values respectively corresponding to a plurality of driving frequencies.

22. The display apparatus of claim 15, wherein the first common voltage is a sine wave modulated during the blank interval.

23. The display apparatus of claim 15, wherein the first common voltage is a triangle wave modulated during the blank interval.

24. The display apparatus of claim 15, further comprising:

a frame masking circuit configured to mask at least one frame between the first and second frames in response to an input signal to extend the blank interval.

25. The display apparatus of claim 24, wherein blank interval determining circuit is further configured to determine a duration of the extended blank interval.

26. The display apparatus of claim 15, wherein the common voltage controller is further configured to generate a second common voltage control signal when the duration is equal to or shorter than the first reference time, and wherein the common voltage generator is further configured to generate a second common voltage in response to the second common voltage control signal, wherein the second common voltage is fixed during the blank interval.

27. A timing controller, comprising: a blank interval determining circuit configured to determine a duration of a blank interval between a first frame and a second frame, wherein the second frame is subsequent to the first frame; wherein the blank interval determining circuit includes an oscillation clock counter configured to count oscillation clocks during the blank interval; a comparing circuit configured to compare the duration with a first reference time; and a common voltage controller configured to generate a common voltage control signal when the duration is longer than the first reference time, wherein the common voltage control signal controls a common voltage to be modulated and an average of the common voltage to be fixed during the blank interval; and a frame masking circuit configured to mask at least one frame between the first and second frames in response to an input signal to extend the blank interval.

28. The timing controller of claim 27, wherein the common voltage control signal controls the common voltage to be swung between a first voltage level and a second voltage level.

29. The timing controller of claim 27, wherein the blank interval determining circuit comprises:

an oscillation clock counter configured to count oscillation clocks during the blank interval.

* * * * *